US011745198B2

(12) United States Patent
Pawluszek et al.

(10) Patent No.: US 11,745,198 B2
(45) Date of Patent: Sep. 5, 2023

(54) SET OF DISPENSING CONTAINERS AND A MAIN DISPENSING CONTAINER

(71) Applicant: Anna Pawluszek, Gliwice (PL)

(72) Inventors: Anna Pawluszek, Gliwice (PL); Michal Wujczak, Wieliczka (PL); Artur Mlynski, Cracow (PL); Artur Terlecki, Strzyzow (PL); Przemyslaw Dobinski, Myslowice (PL); Mateusz Luczynski, Nawojowa Gora (PL)

(73) Assignee: Anna Pawluszek, Gliwice (PL)

( * ) Notice: Subject to any disclaimer, the term of this patent is extended or adjusted under 35 U.S.C. 154(b) by 16 days.

(21) Appl. No.: 17/610,239

(22) PCT Filed: May 8, 2020

(86) PCT No.: PCT/EP2020/062861
§ 371 (c)(1),
(2) Date: Nov. 10, 2021

(87) PCT Pub. No.: WO2020/229342
PCT Pub. Date: Nov. 19, 2020

(65) Prior Publication Data

US 2022/0212216 A1 Jul. 7, 2022

(30) Foreign Application Priority Data

May 10, 2019 (PL) ..... 429899

(51) Int. Cl.
*B05B 11/00* (2023.01)
*B05B 11/02* (2023.01)
*B05B 11/10* (2023.01)

(52) U.S. Cl.
CPC ..... *B05B 11/026* (2023.01); *B05B 11/0056* (2013.01); *B05B 11/104* (2023.01); *B05B 11/1069* (2023.01); *B05B 11/1074* (2023.01)

(58) Field of Classification Search
CPC . B05B 11/026; B05B 11/0056; B05B 11/104; B05B 11/1069; B05B 11/1074
See application file for complete search history.

(56) References Cited

U.S. PATENT DOCUMENTS

| | | | | |
|---|---|---|---|---|
| 8,978,492 | B1 * | 3/2015 | Haworth | G01N 1/14 73/864.34 |
| 9,266,132 | B2 * | 2/2016 | Dumont | A45D 34/02 |
| 9,718,072 | B2 * | 8/2017 | Bruder | B05B 11/00442 |
| 2013/0269830 | A1 * | 10/2013 | Farrar | A45D 34/02 141/27 |
| 2014/0041753 | A1 * | 2/2014 | Beranger | B67D 7/02 141/18 |
| 2014/0102584 | A1 * | 4/2014 | Lasnier | B05B 11/0056 141/18 |

* cited by examiner

*Primary Examiner* — Vishal Pancholi
(74) *Attorney, Agent, or Firm* — Andrew D. Dorisio; Dickinson Wright PLLC

(57) ABSTRACT

The invention relates to a set of dispensing containers (100) for liquid and semi-liquid substances, comprising a main dispening container (1) and a secondary dispensing container (4). The main dispensing container (1) comprises an outlet (2) and a main pump (3) and is suitable for placing more substance therein and for filling of the secondary dispensing container (4), and the secondary dispensing container (4) is suitable for containing a smaller amount of substance and comprises a pumping mechanism, wherein during filling the secondary dispensing container (4) is connected to the main dispensing container (1). A sliding mechanism (7) is located at the outlet (2) of the main dispensing container (1), and the main pump (3) is mounted in the outlet (2) of the main dispensing container (1), said main pump (3) being connected to the atomizer (8) at the outside of the main dispensing container (1). The atomizer (8) is equipped with a control valve (9) for opening and closing of a nozzle (11) of the atomizer (8), and in an upper part of the atomizer (8) an upper valve (10) is located for connecting the channel of the main pump (3) with the secondary dispensing container (4), when the secondary dispensing container (4) is mounted on the atomizer (8). The secondary dispensing container (4) and the outlet (2) of the main dispensing container (1) contain means for a detachable attachment of the secondary dispensing container (4) to the main dispensing container (1).

20 Claims, 10 Drawing Sheets

SET OF DISPENSING CONTAINERS AND A MAIN DISPENSING CONTAINER

Figure 1:
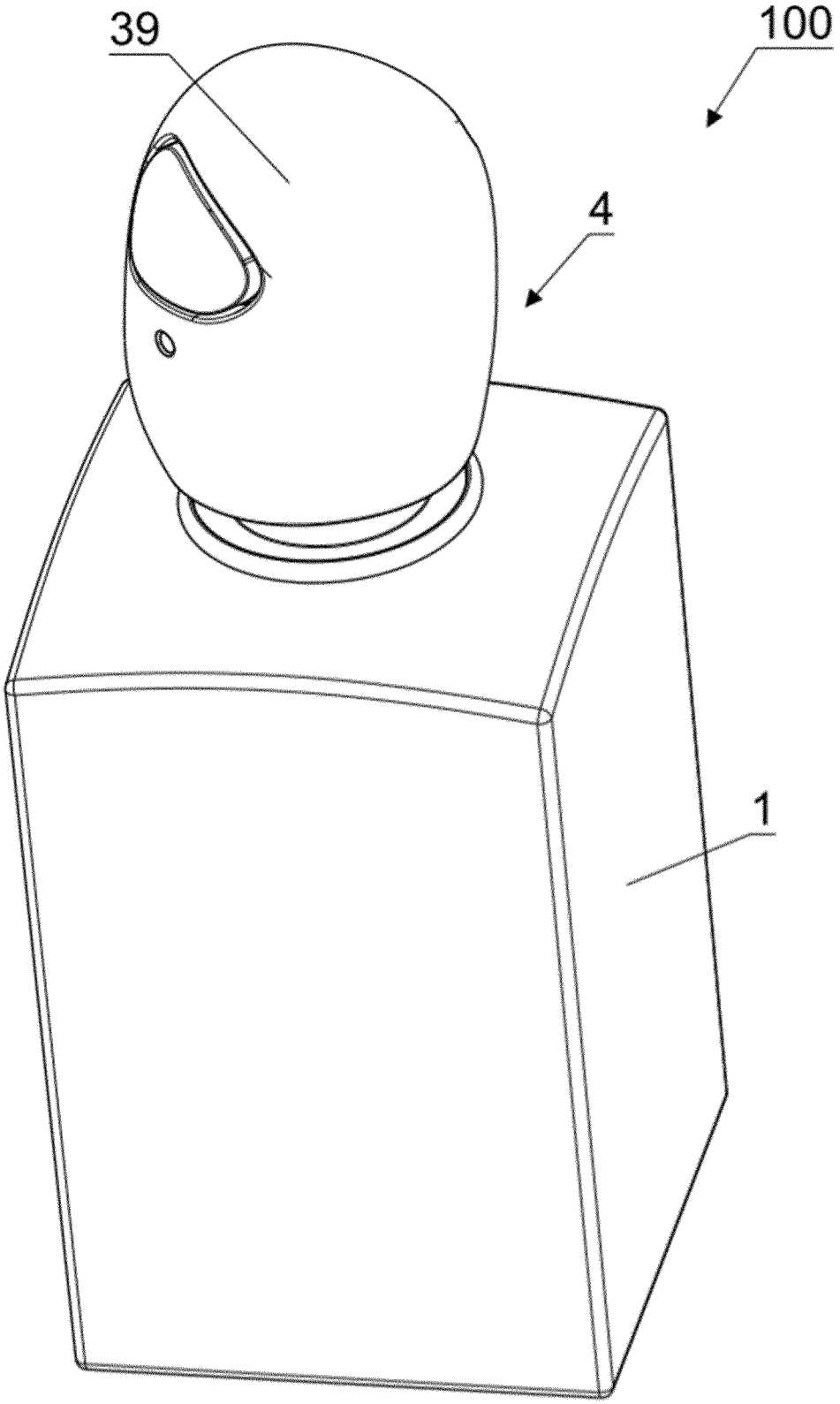

The subject of the invention is a set of dispensing containers for dispensing liquid and semi-liquid substances, for example cosmetics including perfumes, lotions, creams, emulsions and also medicinal substances.

The invention also relates to a main dispensing container for dispensing liquid and semi-liquid substances, for example cosmetics including perfumes, lotions, creams, emulsions and also medicinal substances.

Various types of containers are known for storing and dispensing particularly liquid but also semi-liquid substances at an appropriate moment. They comprise, for example, a bottle equipped with a pump. The task of the pump is to create pressure in the container by manually pressing a button, located outside of the container and connected to the pump. The pressure created causes a substance in the container, such as perfume, to escape through an atomizer to the outside of the container. The atomizer is a device that atomizes a dosed substance in a form of a mist.

A dispenser with a container for an agent to be applied and with a pump for dosing and dispensing of the agent contained in the container, as well as with a pressure-equalizing unit, assigned to the container, characterized in that at least one pressure equalizing hole, which is open to the atmosphere, is assigned to the container for the applied agent, which has a shape of a nozzle, narrowing towards the atmosphere and having a minimum diameter of 0.1 mm to 0.3 mm is known from a polish patent specification no. PL201051B1.

Such containers are used at home practically up to several times a day and are stored, for example, in a home cabinet or on a shelf in the bathroom. Due to frequency of use and ease of storage, such containers have a relatively large volume in order to minimize a need of purchasing substances with the container.

However, such containers become inconvenient if the user of a substance, such as perfumes, needs to travel for a short period of time and wants to take the container along. It turns out that in the event of such a trip, the amount of needed substance is many times smaller than volumes of known containers.

Obviously, it is possible to make very small containers, but this is uneconomical for the user. Therefore, the best solution would be a small container, that one can refill himself from a large container when it's content is used.

Document WO-A-2005/101969 discloses a perfume bottle, refillable from a conventional perfume bottle, which is equipped with a spray system. A spray cap is removed from the perfume bottle and a spray rod is introduced into the bottle to be filled. Perfumes are dispensed from the large bottle into the small refillable bottle by successive vertical pushes to create pressure.

A loading device for loading a refillable bottle is known from a french application no FR2904613A1. It is particularly used for reloading of liquids such as perfumes. The device comprises a container for storing liquids, in particular fragrance agents, loading means located in an upper part of said device, capable of cooperating with refillable bottle filling means and intended for passing fluid from said container into a refillable bottle. The device is characterized in that it comprises guide means, arranged in an upper part of said device and adapted to cooperate with positioning means of said refillable bottle.

A device for dispensing a dose of a given volume of a liquid or pasty product is known from U.S. Pat. No. 5,524,680A. The device comprises a receptacle, capable of containing several doses of the product, a bottle capable of containing a single dose of the product, means for transferring the product from the receptacle into the bottle, and a means for dispensing the dose of product from the bottle, said bottle being adapted to be fixed removably to the receptacle and to slide longitudinally with respect to said receptacle. The device is characterized in that the receptacle is equipped with a first pump, including a hollow control rod for transferring, by forcing, the product from the receptacle into the bottle. The bottle is equipped at one end with a second pump and with a dispensing head for dispensing the dose of product from the bottle, said bottle having, at the other end, a bottom designed to interact with an end of the control rod of the first pump and including a valve sealing off a passage for communication between the receptacle and the bottle formed in said bottom, and opening only under the pressure of the product contained in the receptacle, when the first pump is actuated.

Although the solutions known from the art fulfill their roles, they have drawbacks, which particularly include a need to disassemble elements of a loading container before connecting to it a to-be-loaded container.

Another disadvantage of the known solutions is a need of having two containers and optionally a lid for the loading container, if it is used to dispense a substance contained.

The aim of the invention it to overcome the disadvantages of the state-of-the-art solutions and to develop a set of dispensing containers: a main dispensing container and a secondary dispensing container, wherein it will be possible to integrate the secondary dispensing container with a lid of the main dispensing container and the main dispensing container will be ready for use immediately after the secondary dispensing container is detached.

It is also an object of the invention to provide a construction for the main dispensing container suitable to dispense a substance and to fill other containers with the substance, without performing any dismantling of components of the main dispensing container.

A set of dispensing containers for liquid and semi-liquid substances according to the invention, comprises a main dispensing container and a secondary dispensing container, wherein the main dispensing container comprises an outlet and a main pump and is used for placing more substance in it and for filling of the secondary dispensing container, wherein the secondary dispensing container is for containing a smaller amount of substance and comprises a pumping mechanism. During filling, the secondary dispensing container is connected to the main dispensing container. A sliding mechanism is located at an outlet of the main dispensing container. The main pump is mounted in the outlet of the main dispensing container, wherein an atomizer is connected with the main pump at the outside of the main dispensing container, and the atomizer is equipped with a valve for controling opening and closing of a nozzle of the atomizer. In an upper part of the atomizer an upper valve is located, wherein the upper valve connects a channel of the main pump with the secondary dispensing container when the secondary dispensing container is mounted on the atomizer. The secondary dispensing container and the outlet of the main dispensing container comprise means for a detachable attachment of the secondary dispensing container to the main dispensing container.

Preferably, the atomizer comprises an upper outlet and a small piston, which is loosely supported on a stem and supported by a lower spring in a way that the lower spring pushes the small piston towards the upper outlet of the atomizer. The small piston is provided with a sealing cavity, against which a mushroom-shaped closing end of the stem is pressed. In the upper position of the small piston the interior of the main dispensing container is connected to the nozzle of the atomizer and in the lower position of the small piston the interior of the main dispensing container is connected to the interior of the secondary dispensing container. The position of the small piston in the atomizer is controlled by a pressure element, which is a part of the the secondary dispensing container.

It is advantageous if the sliding mechanism is a ring seated via balls at the outlet of the main dispensing container, the ring being provided with a spiral groove on the inside. The groove enables the ring to be moved relative to the vertical axis of the main dispensing container between a lower position and an upper position, wherein in the upper position of the ring the vertical movement of the secondary dispensing container mounted on the atomizer is blocked with respect to the main dispensing container.

It is also advantageous if the secondary dispensing container comprises a housing, in which an upper body and a lower body are located, wherein a deformable reservoir is placed on or around the lower body and a pumping mechanism is placed in the upper body. A supply valve and a dispensing valve are located in the lower body, the supply valve being connected by means of a lower channel with the deformable reservoir and the dispensing valve being connected by means of an upper channel with the pumping mechanism. The deformable reservoir is a deformable ring-shaped diaphragm, enclosing the lower body and being attached to it by elastic rings on both of its edges, so that the lower channel, which is connected to the supply valve, extends from the lower body onto an inner surface of the reservoir, between the elastic rings.

Preferably, the supply valve is a ball valve, closeable by a compression spring.

Preferably, the dispensing valve is ball valve, closeable by an upper spring.

It is advantageous, when the pumping mechanism is a button, supported by a return spring, the button being connected to a piston, located in a first chamber, said first chamber being provided in the upper body, the first chamber being connected by the upper channel and a side channel with the dispensing valve, and wherein in the upper body, behind the first chamber there is provided a second chamber. The second chamber is connected to an upper atomizer, and between the first chamber and the second chamber a membrane plug is located, the membrane plug being supported by an additional spring, wherein the membrane plug is for controlling the flow of a substance to channels connecting the second chamber with the upper atomizer.

It is also advantageous when the means for a detachable attachment of the secondary dispensing container at the outlet of the main dispensing container is a peripheral internal projection in the lower body of the secondary dispensing container and snap-fits on an external surface of the outlet of the main dispensing container.

Preferably, the housing of the secondary dispensing container forms a cover of the main dispensing container.

A main dispensing container for dispensing liquid and semi-liquid substances according to the invention has an outlet, a main pump and an atomizer. A sliding mechanism is positioned at the outlet of the main dispensing container and the main pump is mounted in the outlet of the main dispensing container. An atomizer is connected to the main pump outside of the main dispensing container, and the atomizer is equipped with a valve that controls opening and closing of the atomizer's nozzle and in an upper part of the atomizer there is an upper valve located for connecting a channel of the main pump with space outside the outlet of the main dispensing container.

Preferably, the sliding mechanism is a ring seated via balls at the outlet of the main dispensing container, an inner side of the ring being provided with a spiral groove through which the ring can be moved relative to the vertical axis of the main dispensing container, between a lower position and an upper position.

It is also advantageous, if the main dispensing container contains means for a detachable attachment of another container to the main dispensing container.

Preferably, the means for a detachable attachment of another container to the main dispensing container are snap-fits on an outer surface of the outlet of the main dispensing container.

Figure 2:
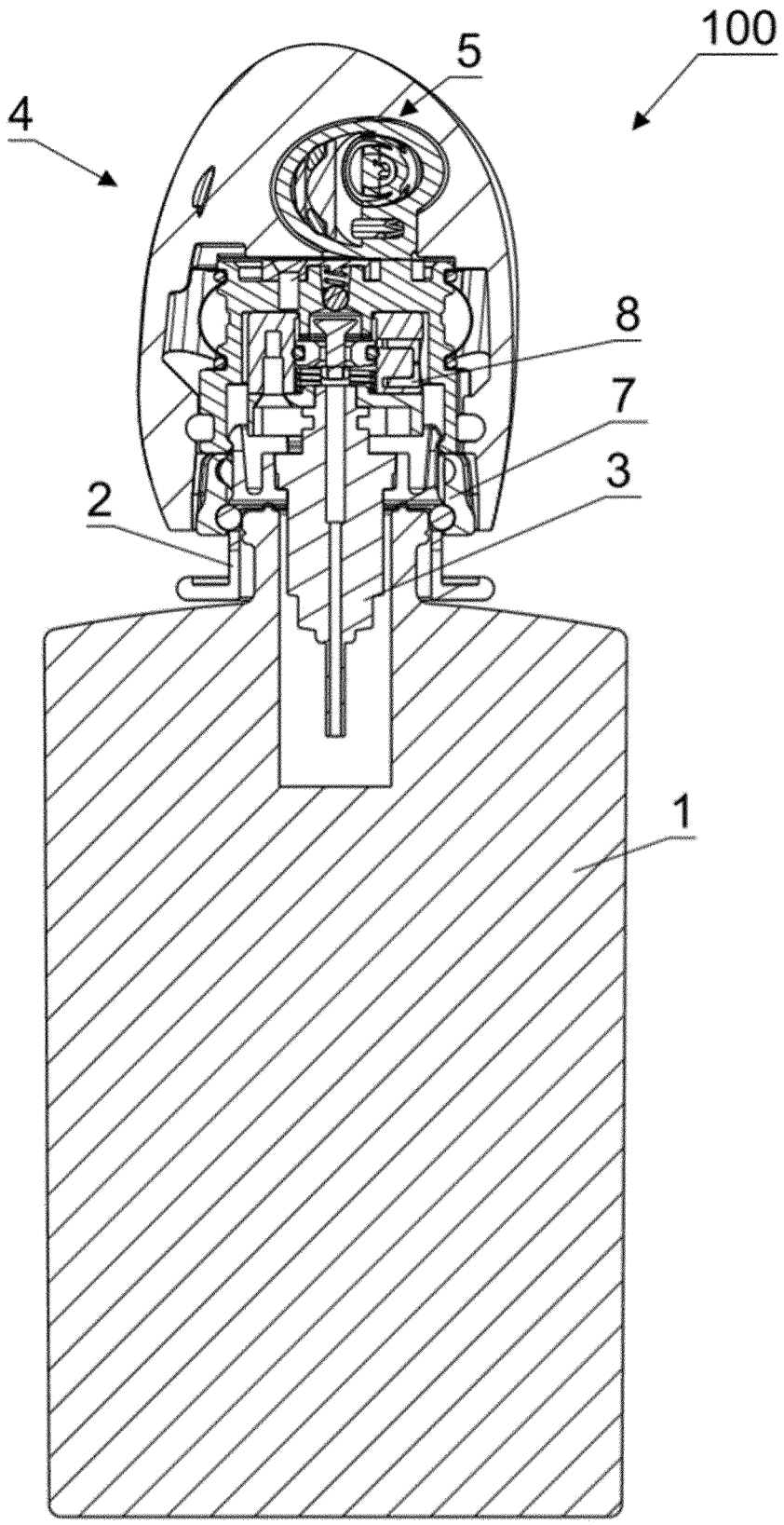
Figure 3:
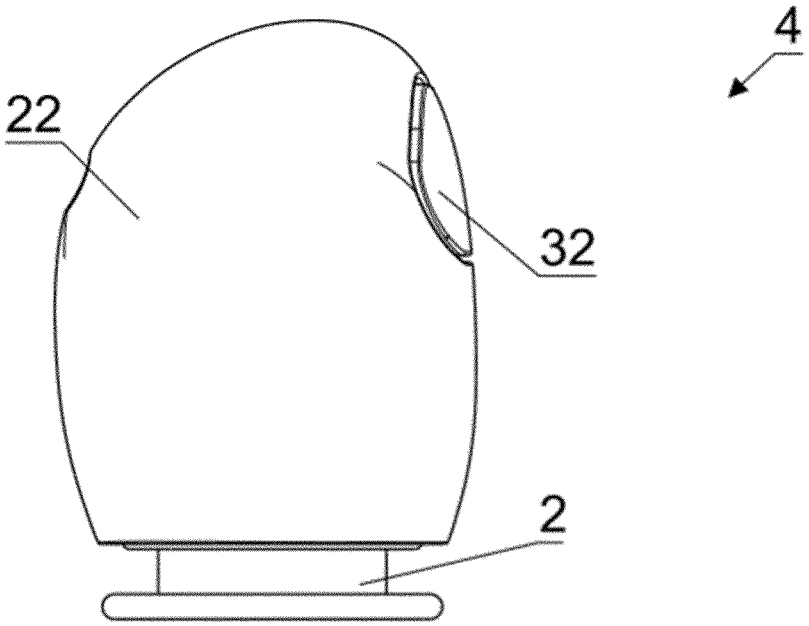
Figure 4:
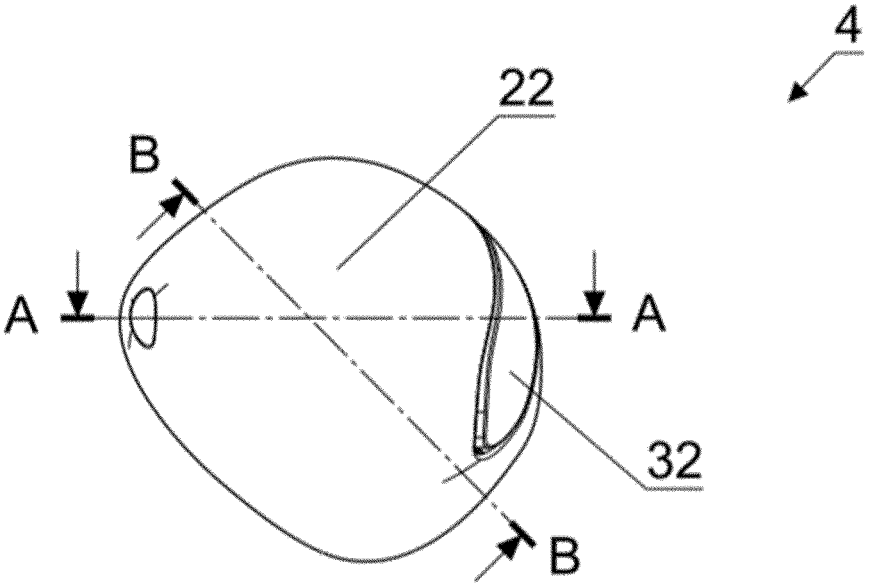
Figure 5:
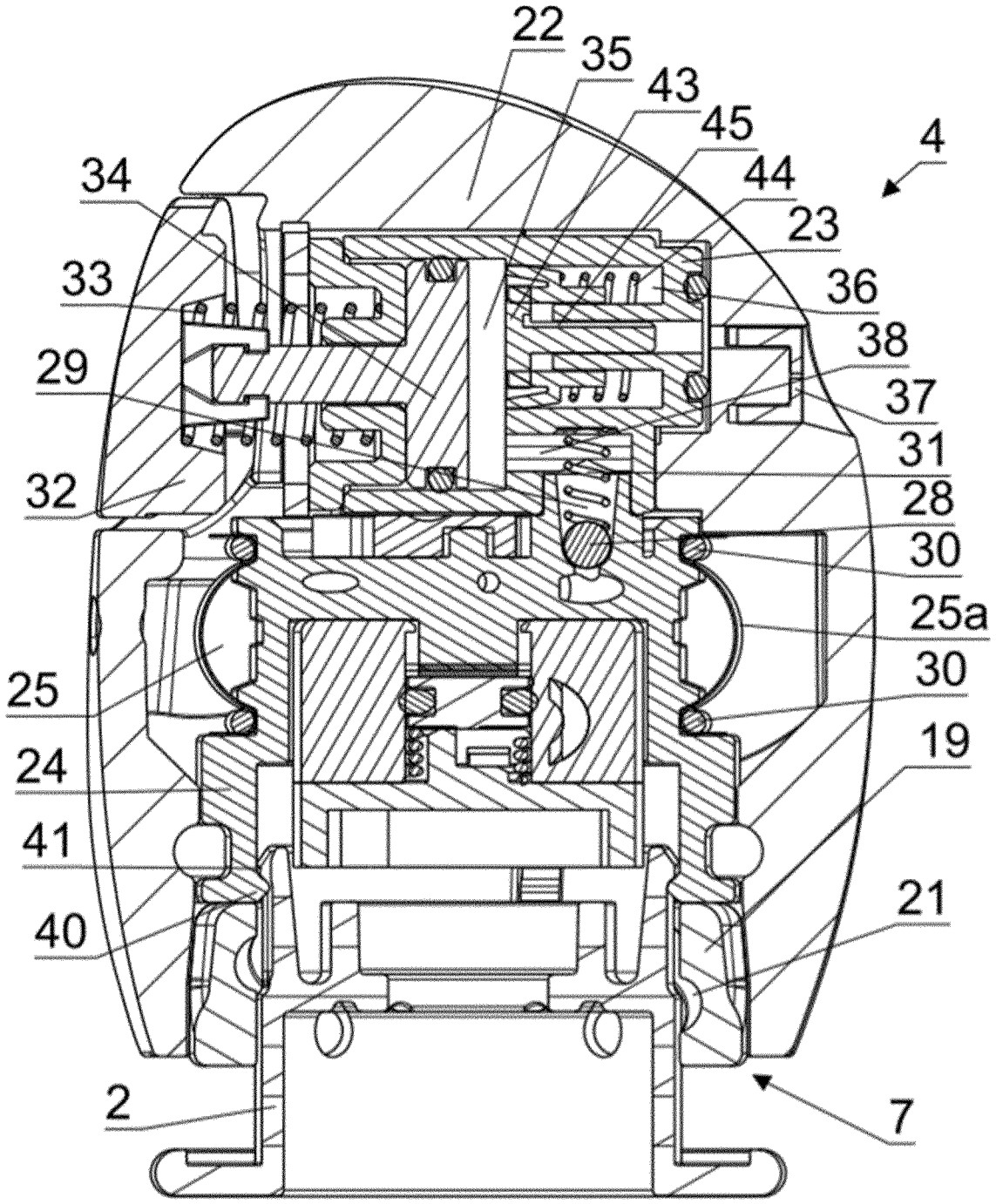
Figure 6:
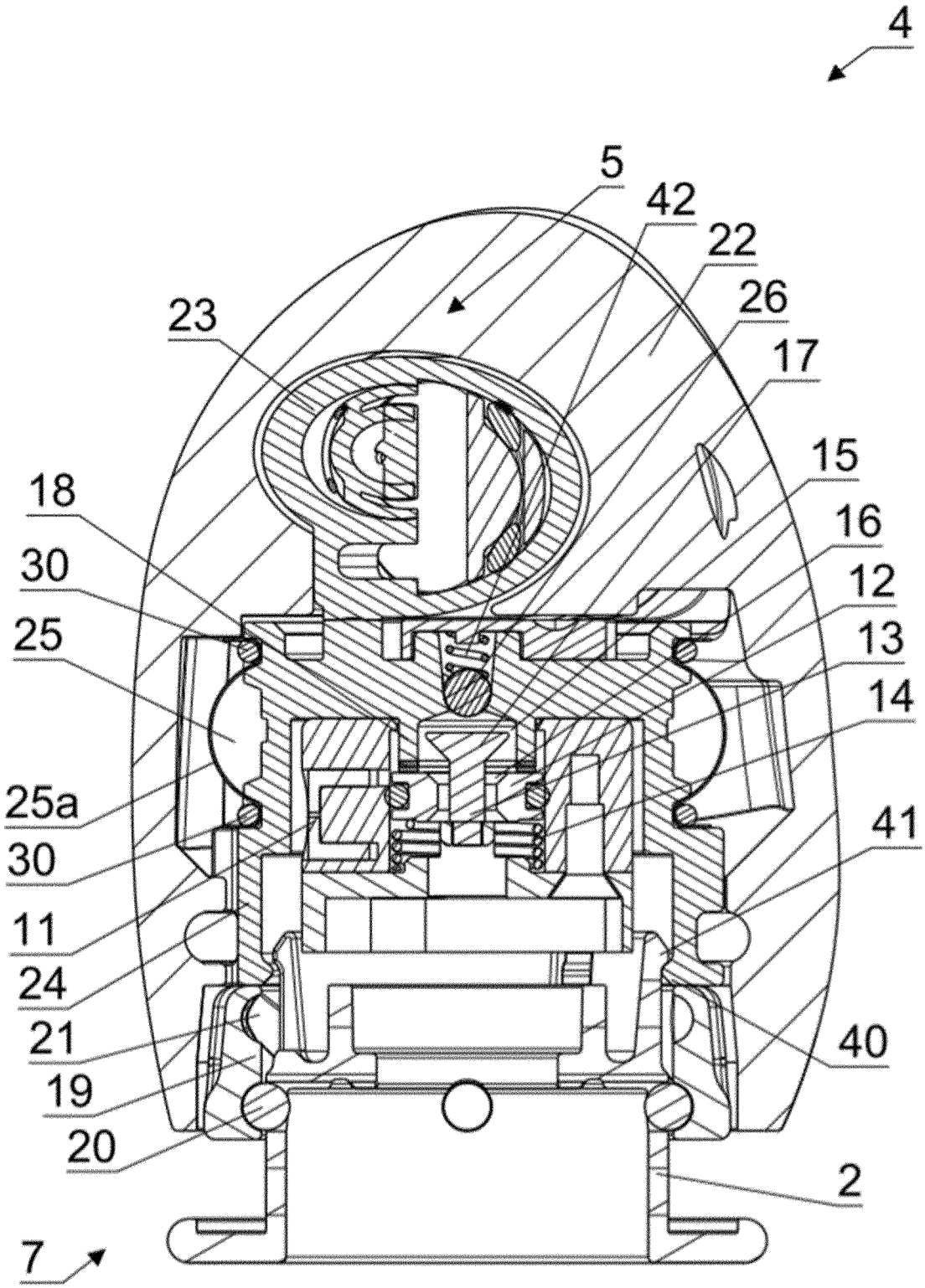
Figure 7:
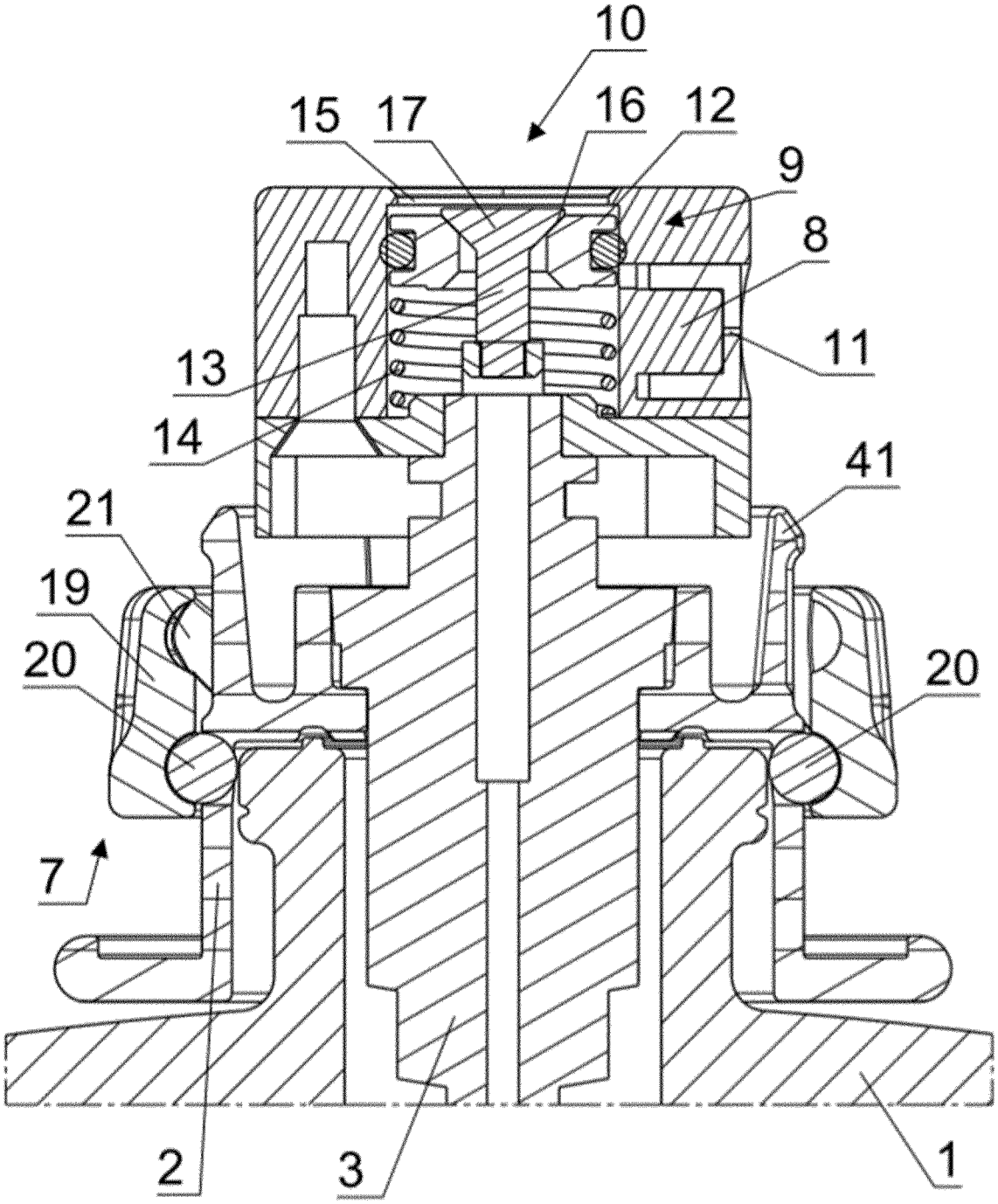
Figure 8:
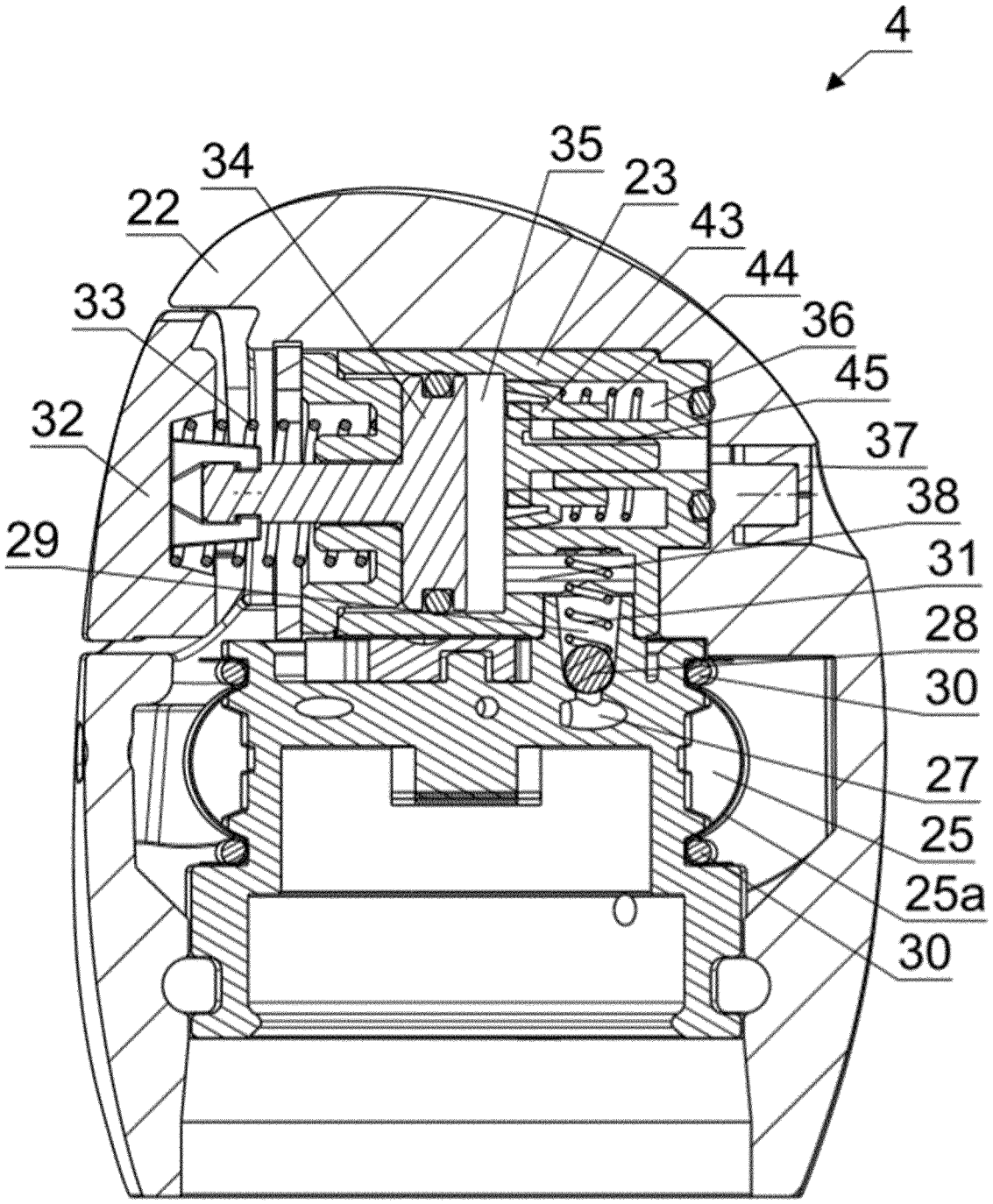
Figure 9:
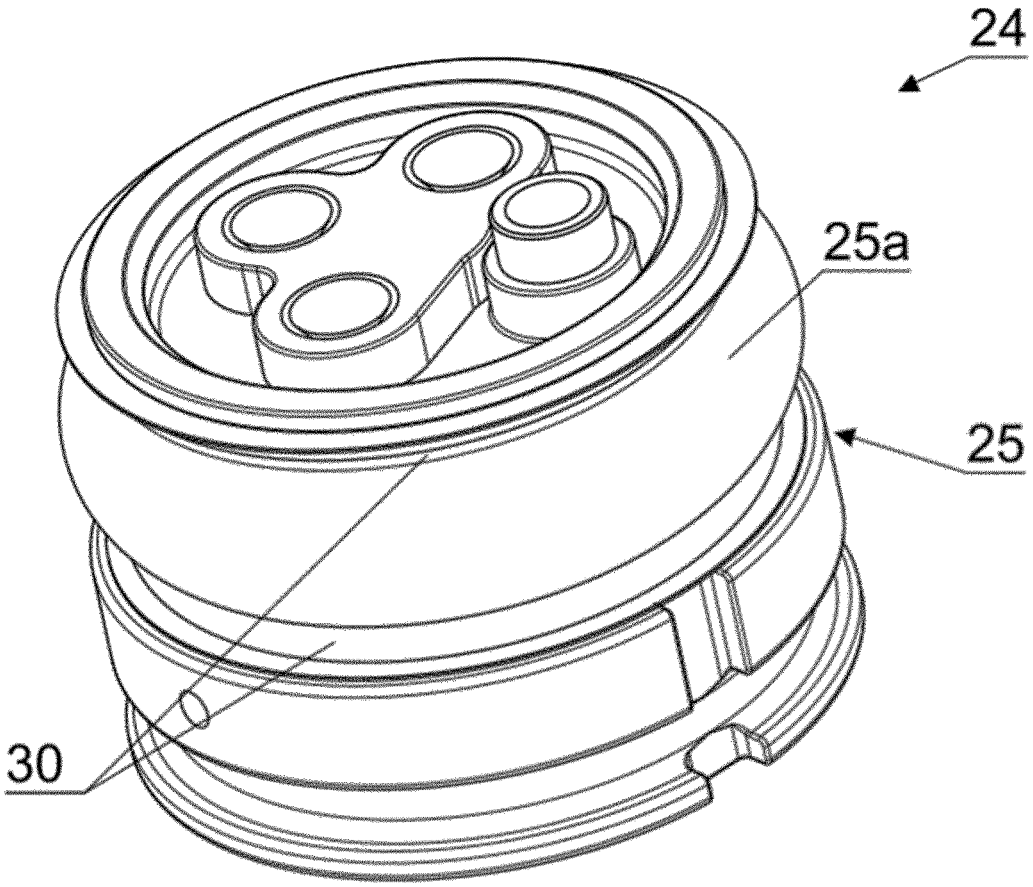
Figure 10:
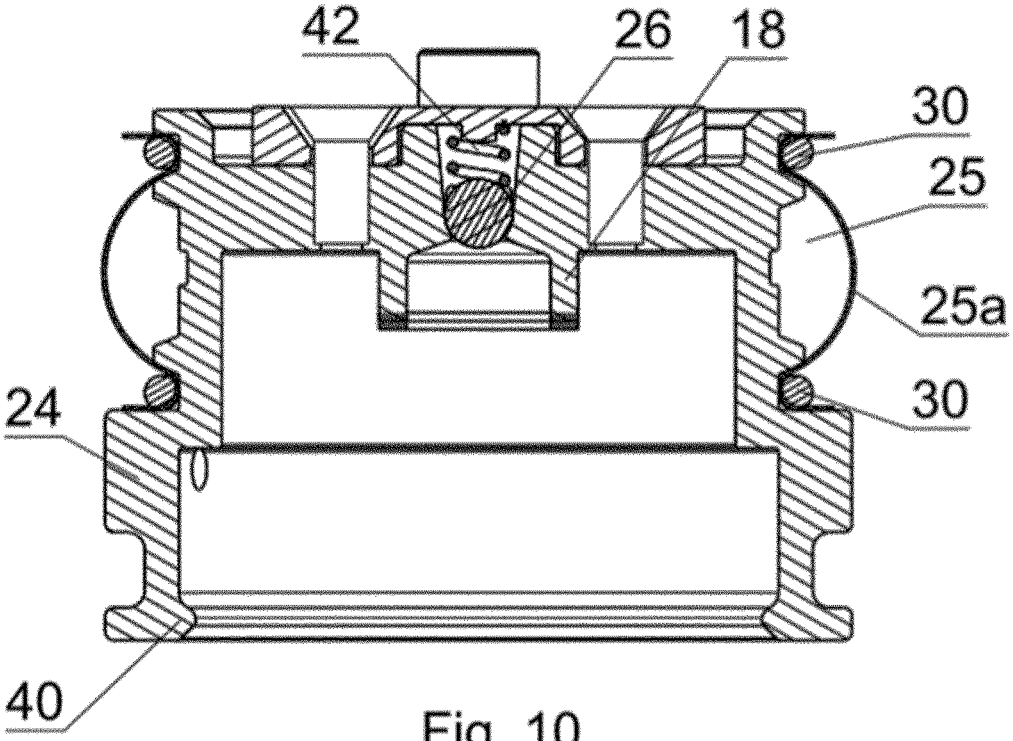
Figure 11:
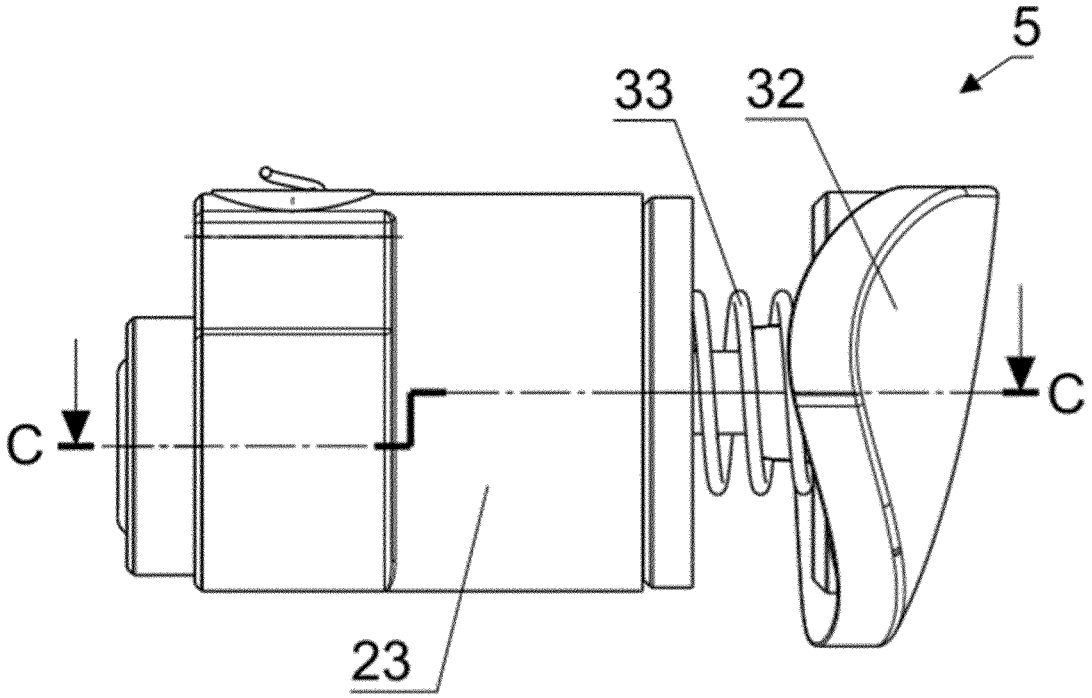
Figure 12:
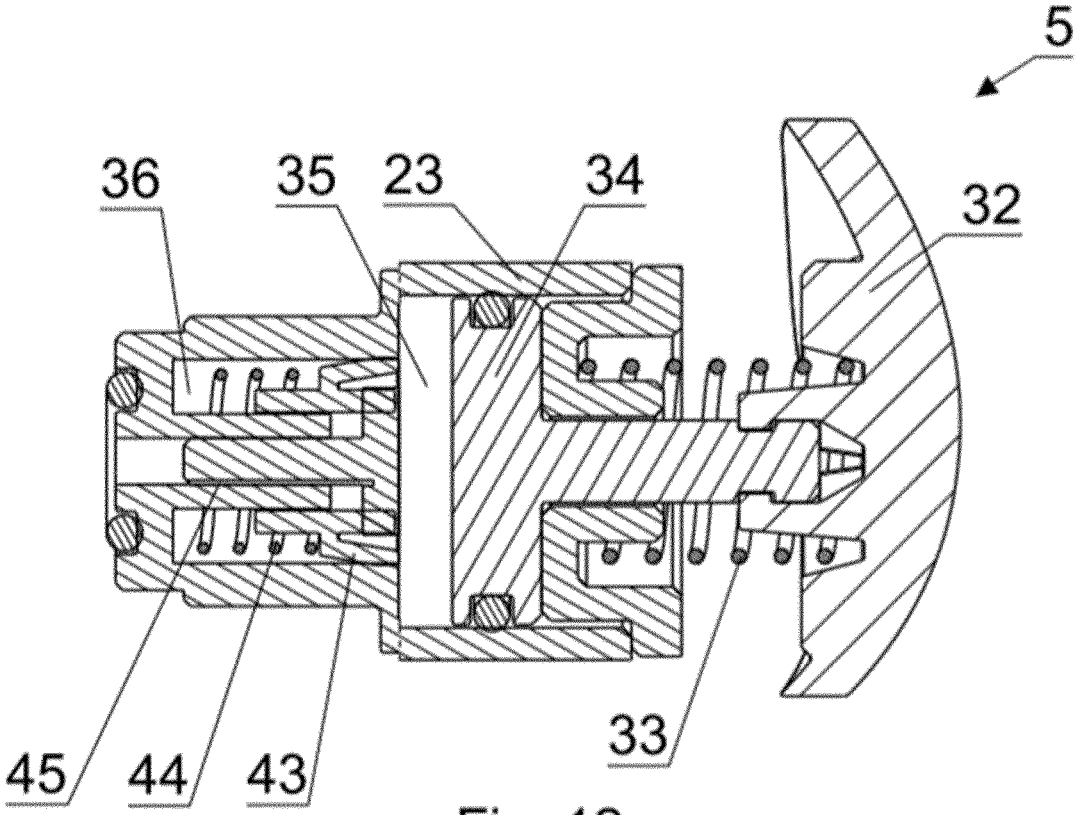
Figure 13:
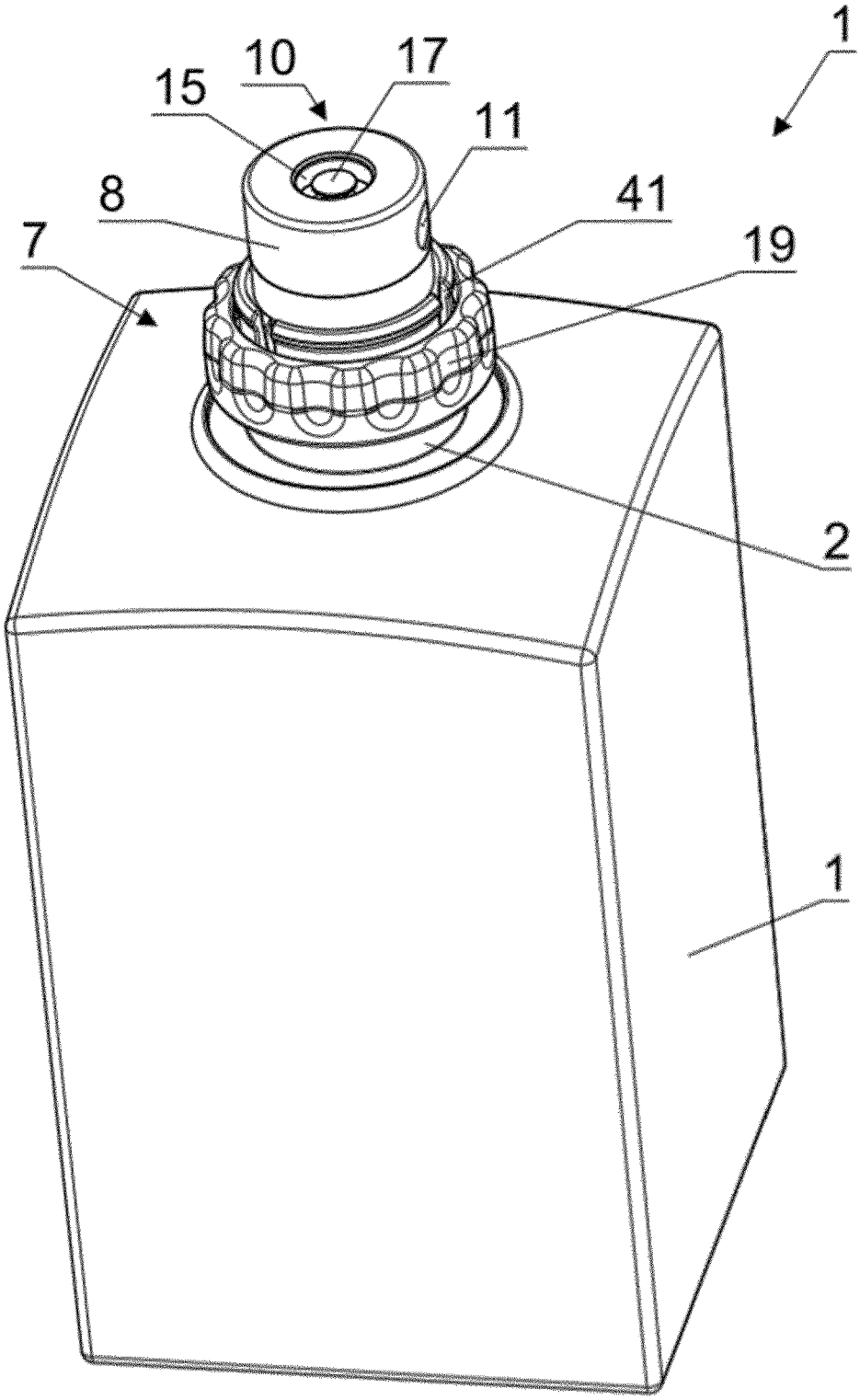

The subject of the invention is shown in an embodiment in the drawings, in which FIG. 1 shows a set of dispensing containers in a side view, containing a main dispensing container and a secondary dispensing container placed thereon, FIG. 2 presents a set of dispensing containers, containing a main dispensing container and a secondary dispensing container placed thereon in cross-section along the vertical axis of the main dispensing container, FIG. 3 shows a side view of a secondary dispensing container, FIG. 4 shows a top view secondary dispensing container, FIG. 5 shows a secondary dispensing container in cross-section along the line AA in FIG. 4, FIG. 6 shows a secondary dispensing container in cross-section along the line BB in FIG. 4, FIG. 7 shows an upper part of a main dispensing container in cross-section along the vertical axis of the main dispensing container, FIG. 8 shows a secondary dispensing container in cross-section as in FIG. 5, FIG. 9 shows a lower body of a secondary dispensing container in perspective side view, FIG. 10 shows a lower body of a secondary dispensing container in sectional view along the vertical axis, FIG. 11 shows a side view of an upper body of a secondary dispensing container, FIG. 12 shows an upper body of a secondary dispensing container in cross section along the line CC in FIG. 11 and FIG. 13 shows a main dispensing container without a secondary dispensing container in a side perspective view.

As shown in an embodiment in FIGS. 1 and 2, a set of dispensing containers 100 for dispensing liquid and semi-liquid substances, for example cosmetics, including perfumes, lotions, creams, emulsions and also medicinal substances comprises a main dispensing container 1 and a secondary dispensing container 4.

The main dispensing container 1, shown in FIG. 2, FIG. 7 and FIG. 13, comprises an outlet 2, which is an open end of the main dispensing container 1, allowing access to its interior. A main pump 3 is located in the outlet 2 of the main dispensing container 1 to provide increased pressure inside the main dispensing container 1, which causes forcing of a substance contained in the main dispensing container 1 to the outside of the main dispensing container 1.

The main dispensing container 1 can contain a larger amount of liquid or semi-liquid substance, such as perfume. The main dispensing container 1 of the container set 100, shown in the embodiment, being also the main dispensing container 1 according to the second aspect of the invention, is suitable to contain more substance, in this case perfumes, which means that it can serve as a perfume dispenser for a long time, for example for a month or more.

At the same time, the main dispensing container 1 in the container set 100 can be used for filling of the secondary dispensing container 4, when the latter is connected to the main dispensing container 1. The secondary dispensing container 4 is suitable for containing less substance, e.g. several single doses. The secondary dispensing container 4 is provided with its own pumping mechanism 5, allowing the secondary dispensing container 4 to be used as a dispenser, in this case, of a perfume, independently of the main dispensing container 1.

At the outlet 2 of the main dispensing container 1 the main pump 3 is mounted, which is connected to an atomizer 8 outside of the main dispensing container 1, as shown in FIG. 2, FIG. 7 and FIG. 13. The task of the atomizer 8 is to ensure a discharge of a liquid or semi-liquid substance contained in the main dispensing container 1, in this embodiment—a perfume, through a nozzle 11 of the atomizer 8, in a form of an aerosol mist. For this purpose, the atomizer 8 of the main dispensing container 1 of the container set 100 or the main dispensing container 1 according to the second aspect of the invention is provided with a valve 9 for opening and closing of the nozzle 11 of the atomizer 8.

An upper outlet 15 is located in an upper part of the atomizer 8 of the main dispensing container 1, said upper outlet 15 connecting a channel of the main pump 3 with space outside the outlet 2 of the main dispensing container 1, wherein the upper outlet 15 is closed by an upper valve 10 during normal use of the main dispensing container 1. If the secondary dispensing container 4 is connected to the main dispensing container 1, the upper valve 10 is opened and connects the interior of the main dispensing container 1 through the channel of the main pump 3 to the interior of the secondary dispensing container 4.

The main dispensing container 1 is equipped with a sliding mechanism 7 at the outlet 2, which in the embodiment shown in FIG. 7, is a ring 19 mounted via balls 20 at the outlet 2 of the main dispensing container 1. From the inside, the ring 19 is provided with a spiral groove 21, through which the ring 19 can be moved relative to the vertical axis of the main dispensing container 1, between a lower position and an upper position. On one hand, the balls 20 guide the movement of the ring 19 and on the other hand, the balls 20 hold the ring in the upper or lower position by seating the balls 20 in the outlet 2 in a manner blocking the ring 19.

The atomizer 8 of the main dispensing container 1 comprises a small piston 12, loosely mounted on a stem 13 in the upper outlet 15 and supported by a lower spring 14, wherein the lower spring 14 pushes the small piston 12 towards the upper outlet 15 of the atomizer 8. The small piston 12 is provided with a sealing cavity 16, to which a mushroom-shaped closing end 17 of the stem 13 is pressed, wherein in the upper position of the small piston 12 the interior of the main dispensing container 1 is connected to the nozzle 11 of the atomizer 8 and in the lower position of the small piston 12 the interior of the main dispensing container 1 is connected to the interior of the secondary dispensing container 4, and the position of the small piston 12 in the atomizer 8 is controlled by a pressure element 18, provided in the secondary dispensing container 4.

According to a second aspect of the invention, there is provided a main dispensing container 1, presented in FIG. 13, which is structurally analogous to the main dispensing container 1 of the first invention, shown in embodiments in FIGS. 2 and 7. In the lower position of the piston small 12, the interior of the main dispensing container 1 is connected to the space outside the main dispensing container 1, but due to a need to push the small piston 12, the opening of the upper valve 10 is generally difficult to accomplish without the secondary dispensing container 4.

In an upper portion of the main dispensing container 1 shown in FIG. 7 for both the set of dispensing containers 100 according to the first aspect of the invention and the main dispensing container 1 according to the second aspect of the invention, the main dispensing container 1 serves for dispensing a liquid substance contained in it, in this embodiment—perfume. Such dosing can take place many times due to the large capacity of the main dispensing container 1. The operation consists of pressing the upper surface of the atomizer 8 of the main dispensing container 1, wherein the upper outlet 15 is located on the upper surface of the atomizer 8, and wherein the upper valve 10 is mounted below the upper outlet 15. The upper valve 10 is slightly depressed into the upper surface of the atomizer 8, which prevents it from being unlocked when pressed. Pressing the atomizer 8 in the manner described above activates the main pump 3, which, in the manner known from the prior art, creates an increased pressure inside the main dispensing container 1, wherein the pressure pushes perfumes through the channel of the main pump 3 to the atomizer 8 and further through the nozzle 11 to the outside of the main dispensing container 1, onto a desired surface in a form of an aerosol mist.

FIG. 1, FIG. 2, FIG. 3, FIG. 4, FIG. 5, FIG. 6 and FIG. 8 show the embodiment of a secondary dispensing container 4, which is also a cover 39 of a main dispensing container 1, as particularly visible in FIG. 1. The cover 39 may have a shape and dimensions known from common perfume bottle covers.

As shown in the embodiment of the first invention, the secondary dispensing container 4 has a shape of an irregularly shaped spatial solid, but it is obvious that it may have a shape of a regular solid, for example a cylinder, cube or other cuboid.

FIG. 5 shows a secondary dispensing container 4 in cross-section along the line A-A in FIG. 4, whereas FIG. 6 shows secondary dispensing container 4 in cross-section along the line B-B in FIG. 4. In the cross-sections of an exemplary secondary dispensing container 4, shown in FIGS. 5 and 6, the secondary dispensing container 4 comprises a housing 22, in which an upper body 23 and a lower body 24 are located. A deformable reservoir 25 is located around the lower body 24 and a pumping mechanism 5 is located in the upper body 23.

The reservoir 25 is a deformable diaphragm 25*a* of a ring shape, enclosing the lower body 24 and being attached to it by elastic rings 30 on both of its edges, as shown in FIG. 5, FIG. 6 and FIG. 8. Obviously, in other embodiments of the invention, the reservoir 25 can have a different shape, such as a shape of a deformable bag, attached to the lower body 24 on one side by the elastic ring 30 and on the other side sealed to an upper surface of the lower body 24 by pressing it with internal elements of the housing 22.

As shown in FIG. 9 in perspective view and in FIG. 10 in cross-section and also in FIG. 8 in cross-section, a supply valve 26 and a dispensing valve 28 are located in the lower body 24, the supply valve 26 being connected by means of a lower channel 27 to the reservoir 25, and a dispensing valve 28 being connected by an upper channel 29 and a side channel 38 with a pumping mechanism 5. In this embodiment, the supply valve 26 is a ball valve, closeable by a compression spring 42. In addition, the compression spring 42 is supported by pressure inside the reservoir 25. It is also possible that the supply valve 26 will only be closed by the pressure inside the reservoir 25. In this embodiment, the dispensing valve 28 is an ball valve, closeable by an upper spring 31. It is obvious that in a rest state, a force of the upper spring 31 of the dispensing valve 28 is greater than a force resulting from the pressure in the reservoir 25, so that the dispensing valve 28 remains closed despite an increase in pressure in the reservoir 25 as a result of pumping liquid into it and stretching the wall of the diaphragm 25*a* of the reservoir 25.

The lower channel 27, connected to the supply valve 26, exits the lower body 24 into the inner surface of the reservoir 25, between the elastic rings 30.

After filling the reservoir 25 and disconnecting the secondary dispensing container 4 from the main dispensing container 1, the secondary dispensing container 4 can be used to dispense the substance contained therein, which is perfume in the embodiment shown in the drawing, particularly in FIG. 3. The secondary dispensing container 4 is a container of a travel type and contains a much smaller amount of substance than can be contained in the main dispensing container 1.

In order to enable dispensing of a substance, such as perfume, from the secondary dispensing container 4, it is provided with the pumping mechanism 5, as shown in the embodiment in FIG. 8, FIG. 11 and FIG. 12. The pumping mechanism 5 is a button 32, wherein the button 32 is connected to a piston 34, the piston 34 being located in a first chamber 35, said first chamber 35 being provided in the upper body 23 of the secondary dispensing container 4. The first chamber 35 of the secondary dispensing container 4 is connected by the side channel 38 and the upper channel 29 to the dispensing valve 28 in the upper body 23. In the upper body 23, behind the first chamber 35, there is a second chamber 36, connected to an upper atomizer 37. Between the first chamber 35 and the second chamber 36 a membrane plug 43 is located, the membrane plug 43 being supported by an additional spring 44, wherein the membrane plug 43 is for controlling of a flow of the substance to channels 45, connecting the second chamber 36 to the upper atomizer 37.

When the user of the secondary dispensing container 4 presses the button 32, the piston 34 compresses the substance contained in the first chamber 35, between the piston 34 and the second chamber 36. The dispensing valve 28 prevents the substance from entering the reservoir 25. The pressure in the first chamber 35, caused by the pressure exerted on the button 32, causes the membrane plug 43, pushed towards the first chamber 35 through the additional spring 44, to be pushed towards the outlet of the upper atomizer 37. This movement of the membrane plug 43 exposes the channels 45, connecting the first chamber 35 to the upper atomizer 37, and results in dispensing the liquid substance, in this embodiment—a perfume, in a form of an aerosol mist.

Releasing the pressure on the button 32 activates a return spring 33, which pulls the piston 34 in the first chamber 35 towards the button 32. This action, in a first aspect, releases the membrane plug 43, which, moving under the action of the additional spring 44 towards the first chamber 35, closes the channels 45 and, in a second aspect, under the influence of the vacuum created, it opens the dispensing valve 28. The substance, which in this embodiment is perfume, passes from the reservoir 25 through the dispensing valve 28 into the first chamber 35 and the secondary dispensing container 4 is ready to dispense another portion of the substance. This can be done by pressing the button 32 again. Of course, this will only be possible until the reservoir 25 of the secondary dispensing container 4 is completely empty.

To refill the secondary dispensing container 4, it must be connected to the main dispensing container 1. To this end, both containers of the container set 100 are provided with means for a detachable attachment of the secondary dispensing container 4 at the outlet 2 of the main dispensing container 1. Means for a detachable attachment of the secondary dispensing container 4 at the outlet 2 the main dispensing container 1 is a peripheral internal projection 40 in the lower body 24 of the secondary dispensing container 4 and snap-fits 41 on an outer surface of the outlet 2 of the main dispensing container 1. Due to their flexibility with little resistance, the peripheral internal projection 40 in the lower body 24 of the secondary dispensing container 4 and the snap-fits 41 on the outer surface of the outlet 2 of the main dispensing container 1 allow to connect and disconnect the secondary dispensing container 4 and the main dispensing container 1.

When the secondary dispensing container 4 is connected to the main dispensing container 1 by the means for a detachable attachment provided above, the main dispensing container 1 cannot be used as an applicator of the substance contained therein, because the pressure element 18 of the secondary dispensing container 4, as shown in the embodiment in FIG. 6 and FIG. 10, pressing the small piston 12 causes it to move towards the outlet 2 of the main dispensing container 1, and thus, closes the flow of liquid or semi-liquid substance from the main dispensing container 1 to the nozzle 11 of the atomizer 8. As long as the secondary dispensing container 4 is seated on the main dispensing container 1, a supply of substance from the main dispensing container 1 to the atomizer's nozzle 11 is closed and a supply to the supply valve 26 of the secondary dispensing container 4 is open.

In contrast, the possibility of filling the secondary dispensing container 4 depends on the position of the sliding mechanism 7. The sliding mechanism 7 can be positioned in one of two positions: upper or lower position by displacement by turning the ring 19 seated via balls 20 as shown in FIG. 2, FIG. 6 and FIG. 13 in the embodiment. Displacement of the ring 19 to the upper position makes it impossible to press the main pump 3 of the main dispensing container 1 through the secondary dispensing container 4, as it is prevented by resistance of the ring 19. Filling of the secondary dispensing container 4 is possible after placing the secondary dispensing container 4 on the main dispensing container 1 and placing the ring 19 of the sliding mechanism 7 in the lower position. In this position, the ring 19 does not limit the possibility of vertical movement of the secondary dispensing container 4 and its filling.

List of reference numerals, presented on the figures:

1—main dispensing container
2—outlet of the main dispensing container
3—main pump
4—secondary dispensing container
5—pumping mechanism
7—sliding mechanism
8—atomizer
9—valve for opening and closing of the nozzle 11
10—upper valve
11—atomizer's nozzle/nozzle of the atomizer
12—small piston
13—stem
14—lower spring

15—upper outlet
16—sealing cavity
17—mushroom-shaped closing end
18—pressure element
19—ring
20—balls
21—groove
22—housing
23—upper body
24—lower body
25—reservoir, 25*a*—diaphragm
26—supply valve
27—lower channel
28—dispensing valve
29—upper channel
30—elastic rings
31—upper spring
32—button
33—return spring
34—piston
35—first chamber
36—second chamber
37—upper atomizer
38—side channel
39—cover
40—peripheral internal projection
42—compression spring
43—membrane plug
44—additional spring
45—channels
100—set of containers

The invention claimed is:

1. A set of dispensing containers for liquid and semi-liquid substances, containing a main dispensing container and a secondary dispensing container, wherein the main dispensing container comprises an outlet and a main pump and is suitable for placing more substance therein and for filling of the secondary dispensing container, wherein the secondary dispensing container is suitable for containing a smaller amount of substance therein and comprises a pumping mechanism, wherein during filling of the secondary dispensing container it is connected to the main dispensing container, wherein the main pump (3) is mounted in the outlet (2) of the main dispensing container (1), said main pump (3) being connected to the atomizer (8) outside of the main dispensing container (1), wherein the atomizer (8) is equipped with a valve (9) for controlling opening and closing of a nozzle (11) of the atomizer (8), and wherein in the upper part of the atomizer (8) an upper valve (10) is located, said upper valve (10) connects a channel of the main pump (3) with the secondary dispensing container (4) when the secondary dispensing container (4) is mounted on the atomizer (8), wherein the secondary dispensing container (4) and the outlet (2) of the main dispensing container (1) contain means for a detachable attachment of the secondary dispensing container (4) to the main dispensing container (1) characterized in that the main dispensing container (1) further comprises a sliding mechanism (7) positioned at the outlet (2) such that, when the second dispensing container (4) is mounted on the atomizer (8), said sliding mechanism (7) moves relative to the vertical axis of the main dispensing container (1) between a lower position and an upper position, wherein in the upper position the vertical movement of the secondary dispensing container (4) relative to the main dispensing container (1) is blocked thereby preventing filing of the secondary dispensing container (4), and wherein in the lower position the vertical movement of the secondary dispensing container (4) relative to the main dispensing container (1) is unblocked thereby making filing of the secondary dispensing container (4) possible.

2. The set of containers according to claim 1, characterized in that the atomizer (8) comprises an upper outlet (15) and a small piston (12), said small piston (12) being loosely mounted on a stem (13) and supported by a lower spring (14) in a way that the lower spring (14) pushes the small piston (12) towards the upper outlet (15) of the atomizer (8), wherein the small piston (12) is provided with a sealing cavity (16), against which a mushroom-shaped closing end (17) of the stem (13) is pressed, wherein in an upper position of the small piston (12) the interior of the main dispensing container (1) is connected to the nozzle (11) of the atomizer (8) and in a lower position of the small piston (12) the interior of the main dispensing container (1) is connected to the interior of the secondary dispensing container (4) and the position of the small piston (12) in the atomizer (8) is controlled by a pressure element (18), which is a part of the secondary dispensing container (4).

3. The set of containers according to claim 1, characterized in that the sliding mechanism (7) is a ring (19) seated via balls (20) at the outlet (2) of the main dispensing container (1), the ring (19) being provided with a spiral groove (21) on the inside, wherein the groove (21) enables the ring (19) to be moved relative to the vertical axis of the main dispensing container (1) between a lower position and an upper position, wherein in the upper position of the ring (19) the vertical movement of the secondary dispensing container (4) mounted on the atomizer (8) is blocked with respect to the main dispensing container (1).

4. The set of containers according to claim 1, characterized in that the secondary dispensing container (4) comprises a housing (22) in which an upper body (23) and a lower body (24) are located, wherein a deformable reservoir (25) is placed on or around the lower body (24) and the pumping mechanism (5) is placed in the upper body (23), wherein a supply valve (26) and a dispensing valve (28) are located in the lower body (24), the supply valve (26) being connected by means of a lower channel (27) with the deformable reservoir (25) and the dispensing valve (28) being connected by means of an upper channel (29) with the pumping mechanism (5), wherein the deformable reservoir (25) is a deformable ring-shaped diaphragm (25*a*), enclosing the lower body (24) and attached to it by elastic rings (30) on both of its edges, so that the lower channel (27), which is connected to the supply valve (26), extends from the lower body (24) onto an inner surface of the reservoir (25), between the elastic rings (30).

5. The set of containers according to claim 4, characterized in that the supply valve (26) is a ball valve, closeable by a compression spring (42).

6. The set of containers according to claim 4, characterized in that the dispensing valve (28) is ball valve, closeable by an upper spring (31).

7. The set of containers according to claim 4, characterized in that the pumping mechanism (5) is a button (32), supported by a return spring (33), the button (32) being connected to a piston (34), located in a first chamber (35), said first chamber (35) being provided in the upper body (23), the first chamber (35) being connected by the upper channel (29) and a side channel (38) with the dispensing valve (28), and wherein in the upper body (23), behind the first chamber (35) there is provided a second chamber (36), said second chamber (36) being connected to an upper atomizer (37), and between the first chamber (35) and the second chamber (36) a membrane plug (43) is located, the membrane plug (43) being supported by an additional spring (44), wherein the membrane plug (43) is for controlling the flow of a substance to channels (45) connecting the second chamber (36) with the upper atomizer (37).

8. The set of containers according to claim 1, characterized in that the means for a detachable attachment of the secondary dispensing container (4) at the outlet (2) of the main dispensing container (1) is a peripheral internal projection (40) in the lower body (24) of the secondary dispensing container (4) and snap-fits (41) on an external surface of the outlet (2) of the main dispensing container (1).

9. The set of containers according to claim 1, characterized in that a housing (22) of the secondary dispensing container (4) forms a cover (39) of the main dispensing container (1).

10. A main dispensing container for dispensing liquid and semi-liquid substances, suitable for placing more substance therein and for filling of a secondary dispensing container (4) which is suitable for containing a smaller amount of substance therein and connectable to the main dispensing container (1), said main dispensing container (1) comprises an outlet, a main pump and an atomizer, wherein the main pump (3) is mounted in the outlet (2) of the main dispensing container (1), wherein an atomizer (8) is connected to the main pump (3) outside of the main dispensing container (1), and the atomizer (8) is equipped with a valve (9) for controlling of opening and closing of a nozzle (11) of the atomizer (8), wherein in an upper part of the atomizer (8) there is an upper valve (10) located for connecting a channel of the main pump (3) with space outside the outlet (2) of the main dispensing container (1), characterized in that the main dispensing container further comprises a sliding mechanism (7) positioned at the outlet (2) of the main dispensing container (1) such that, when the second dispensing container (4) is mounted on the atomizer (8), said sliding mechanism (7) can be moved relative to the vertical axis of the main dispensing container (1) between a lower position and an upper position, wherein in the upper position the vertical movement of the secondary dispensing container (4) relative to the main dispensing container (1) is blocked thereby preventing filing of the secondary dispensing container (4), and wherein in the lower position the vertical movement of the secondary dispensing container (4) relative to the main dispensing container (1) is unblocked thereby making filing of the secondary dispensing container (4) possible.

11. The main dispensing container according to claim 10, characterized in that the sliding mechanism (7) is a ring (19) seated via balls (20) at the outlet (2) of the main dispensing container (1), wherein an inner side of the ring (19) is provided with a spiral groove (21), through which the ring (19) can be moved relative to the vertical axis of the main dispensing container (1), between a lower position and an upper position.

12. The main dispensing container according to claim 10, characterized in that it comprises means for a detachable attachment of the secondary dispensing container (4) to the main dispensing container (1).

13. The main dispensing container according to claim 12, characterized in that the means for a detachable attachment of the secondary dispensing container (4) to the main dispensing container (1) are snap-fits (41) on an outer surface of the outlet (2) of the main dispensing container (1).

14. A set of dispensing containers for liquid and semi-liquid substances, containing a main dispensing container and a secondary dispensing container, wherein the main dispensing container comprises an outlet and a main pump and is suitable for placing more substance therein and for filling of the secondary dispensing container, wherein the secondary dispensing container is suitable for containing a smaller amount of substance therein and comprises a pumping mechanism, wherein during filling of the secondary dispensing container it is connected to the main dispensing container, wherein the main pump (3) is mounted in the outlet (2) of the main dispensing container (1), said main pump (3) being connected to the atomizer (8) outside of the main dispensing container (1), wherein the atomizer (8) is equipped with a valve (9) for controlling opening and closing of a nozzle (11) of the atomizer (8), and wherein in the upper part of the atomizer (8) an upper valve (10) is located, said upper valve (10) connects a channel of the main pump (3) with the secondary dispensing container (4) when the secondary dispensing container (4) is mounted on the atomizer (8), wherein the secondary dispensing container (4) and the outlet (2) of the main dispensing container (1) contain means for a detachable attachment of the secondary dispensing container (4) to the main dispensing container (1), characterized in that the atomizer (8) comprises an upper outlet (15) and a small piston (12), said small piston (12) being loosely mounted on a stem (13) and supported by a lower spring (14) in a way that the lower spring (14) pushes the small piston (12) towards the upper outlet (15) of the atomizer (8), wherein the small piston (12) is provided with a sealing cavity (16), against which a mushroom-shaped closing end (17) of the stem (13) is pressed, wherein in an upper position of the small piston (12) the interior of the main dispensing container (1) is connected to the nozzle (11) of the atomizer (8) and in a lower position of the small piston (12) the interior of the main dispensing container (1) is connected to the interior of the secondary dispensing container (4) and the position of the small piston (12) in the atomizer (8) is controlled by a pressure element (18), which is a part of the secondary dispensing container (4).

15. The set of containers according to claim 1, characterized in that the sliding mechanism (7) is a ring (19) seated via balls (20) at the outlet (2) of the main dispensing container (1), the ring (19) being provided with a spiral groove (21) on the inside, wherein the groove (21) enables the ring (19) to be moved relative to the vertical axis of the main dispensing container (1) between a lower position and an upper position, wherein in the upper position of the ring (19) the vertical movement of the secondary dispensing container (4) mounted on the atomizer (8) is blocked with respect to the main dispensing container (1).

16. The set of containers according to claim 1, characterized in that the secondary dispensing container (4) comprises a housing (22) in which an upper body (23) and a lower body (24) are located, wherein a deformable reservoir (25) is placed on or around the lower body (24) and the pumping mechanism (5) is placed in the upper body (23), wherein a supply valve (26) and a dispensing valve (28) are located in the lower body (24), the supply valve (26) being connected by means of a lower channel (27) with the deformable reservoir (25) and the dispensing valve (28) being connected by means of an upper channel (29) with the pumping mechanism (5), wherein the deformable reservoir (25) is a deformable ring-shaped diaphragm (25*a*), enclosing the lower body (24) and attached to it by elastic rings (30) on both of its edges, so that the lower channel (27), which is connected to the supply valve (26), extends from the lower body (24) onto an inner surface of the reservoir (25), between the elastic rings (30).

17. The set of containers according to claim 4, characterized in that the supply valve (26) is a ball valve, closeable by a compression spring (42).

18. The set of containers according to claim 4, characterized in that the dispensing valve (28) is ball valve, closeable by an upper spring (31).

19. The set of containers according to claim 4, characterized in that the pumping mechanism (5) is a button (32), supported by a return spring (33), the button (32) being connected to a piston (34), located in a first chamber (35), said first chamber (35) being provided in the upper body (23), the first chamber (35) being connected by the upper channel (29) and a side channel (38) with the dispensing valve (28), and wherein in the upper body (23), behind the first chamber (35) there is provided a second chamber (36), said second chamber (36) being connected to an upper atomizer (37), and between the first chamber (35) and the second chamber (36) a membrane plug (43) is located, the membrane plug (43) being supported by an additional spring (44), wherein the membrane plug (43) is for controlling the flow of a substance to channels (45) connecting the second chamber (36) with the upper atomizer (37).

20. The set of containers according to claim 1, characterized in that the means for a detachable attachment of the secondary dispensing container (4) at the outlet (2) of the main dispensing container (1) is a peripheral internal projection (40) in the lower body (24) of the secondary dispensing container (4) and snap-fits (41) on an external surface of the outlet (2) of the main dispensing container (1).

* * * * *